United States Patent [19]

Coshow

[11] Patent Number: 4,474,235

[45] Date of Patent: Oct. 2, 1984

[54] WELL TOOL DISLODGEMENT APPARATUS

[76] Inventor: Chester L. Coshow, P.O. Box 843, Chickasha, Okla. 73018

[21] Appl. No.: 414,524

[22] Filed: Sep. 2, 1982

[51] Int. Cl.[3] ..... E21B 17/10

[52] U.S. Cl. ..... 166/241

[58] Field of Search ..... 166/241, 170; 175/325, 175/4.51; 308/4 A; 15/104.16, 104.2; 16/29, 31 R, 31 A, 18 R

[56] References Cited

U.S. PATENT DOCUMENTS

| | | | |
|---|---|---|---|
| 202,519 | 4/1878 | Chapin | 15/104.16 |
| 226,740 | 4/1880 | Gable | 15/104.16 |
| 762,081 | 6/1904 | McNulty | 16/18 |
| 1,281,756 | 10/1918 | Black | 308/4 A |
| 1,298,131 | 3/1919 | Wilkirson | 166/241 |
| 1,338,917 | 5/1920 | Hall | 15/162 |
| 1,339,955 | 5/1920 | Hardel | 166/254 |
| 2,292,938 | 8/1942 | Hennessy | 255/1 |
| 2,329,876 | 9/1943 | Castellano | 285/90 |
| 2,870,541 | 1/1959 | Mayes | 33/178 |
| 2,964,110 | 12/1960 | Garwood et al. | 166/241 |
| 3,364,464 | 1/1968 | Dellinger | 340/18 |
| 3,401,988 | 9/1968 | Pingree | 308/4 |
| 3,572,442 | 3/1971 | Templeton | 166/212 |
| 3,978,924 | 9/1976 | Roesner | 166/241 |
| 3,984,627 | 10/1976 | Galerne | 178/6.8 |
| 4,243,099 | 1/1981 | Rodgers, Jr. | 166/241 |

*Primary Examiner*—James A. Leppink
*Assistant Examiner*—Hoang C. Dang
*Attorney, Agent, or Firm*—E. Harrison Gilbert, III

[57] ABSTRACT

The apparatus includes a sleeve which is attachable to a tool to be lowered into an uncased well bore. The sleeve has a roller mechanism connected in longitudinal relationship therewith so that the wheel is disposed beneath the tool as the tool is lowered into the well bore. The wheel has a slightly larger diameter than the maximum outer dimension of the sleeve so that the wheel will engage the surface of the uncased well bore and prevent the tool from becoming lodged on an indentation of the uncased well bore.

13 Claims, 5 Drawing Figures

WELL TOOL DISLODGEMENT APPARATUS

BACKGROUND OF THE INVENTION

This invention relates generally to apparatus for assisting the lowering of an object into a well and more particularly, but not by way of limitation, to apparatus for preventing a logging tool from becoming stuck on a ledge of an uncased well bore.

An uncased well bore often has indentations in the wall defining the bore. These indentations have ledges upon which an elongated logging tool being lowered into the well can become lodged or stuck. It has been the practice that when a tool becomes stuck on such a ledge, the tool be moved up and down (called "yo-yoing" the tool) until the tool is dislodged from the ledge. This "yo-yoing" is often time-consuming because it can take several up-and-down repetitions to dislodge the tool, and it is sometimes totally ineffectual. "Yo-yoing" may even damage the tool if it causes the tool to be banged into the ledge too often or too hard.

To enhance the effectiveness of the "yo-yoing" procedure or to preclude the necessity of "yo-yoing", there is the need for a roller mechanism which can be connected to a tool which is to be lowered into a well. Although there are presently disclosed downhole tool devices which have wheels, these wheels generally extend laterally from the tool so that they can ride along the interior surface of the casing or the surface of the wall defining the uncased well bore. However, I am not aware of any such wheel mechanisms which extend directly beneath a tool as it is lowered into a well or, more generally, of a well tool dislodgement apparatus having the simplified construction of my invention. It is this positioning of a wheel, or more generally a roller, mechanism and the simplified construction of my invention which have been previously unsatisfied needs in the oil and gas industry in which the "yo-yoing" and other prior art methods and apparatus have generally been used.

SUMMARY OF THE INVENTION

The present invention satisfies these needs and overcomes the above-noted and other shortcomings of the prior art by providing a novel and improved apparatus for assisting in the lowering of an element into a well.

Broadly, the present invention provides an apparatus for assisting the lowering of a tool or other object (such as casing, for example) into a well whereby the tool or other object is prevented from becoming stuck on a ledge defined in a wall which defines an uncased well bore of the well. The apparatus includes adapter shoe means for coupling the apparatus with the tool or other object, roller means for engaging the wall of the well bore, and roller attachment means for attaching the roller means to an end of the adapter shoe means in longitudinally spaced relationship therewith.

From the foregoing, it is an object of the present invention to provide an apparatus for keeping an object from becoming stuck on a ledge in an uncased well bore. It is also an object of the present invention that such apparatus have a simple construction so that it is easy to use and maintain and simple and inexpensive to manufacture. More generally, it is an object of the present invention to provide a novel and improved apparatus for assisting the lowering of an object into a well.

Other and further objects, features and advantages of the present invention will be readily apparent to those skilled in the art when the following description of the preferred embodiment is read in conjunction with the accompanying drawings.

DESCRIPTION OF THE PREFERRED EMBODIMENT

Figure 1:
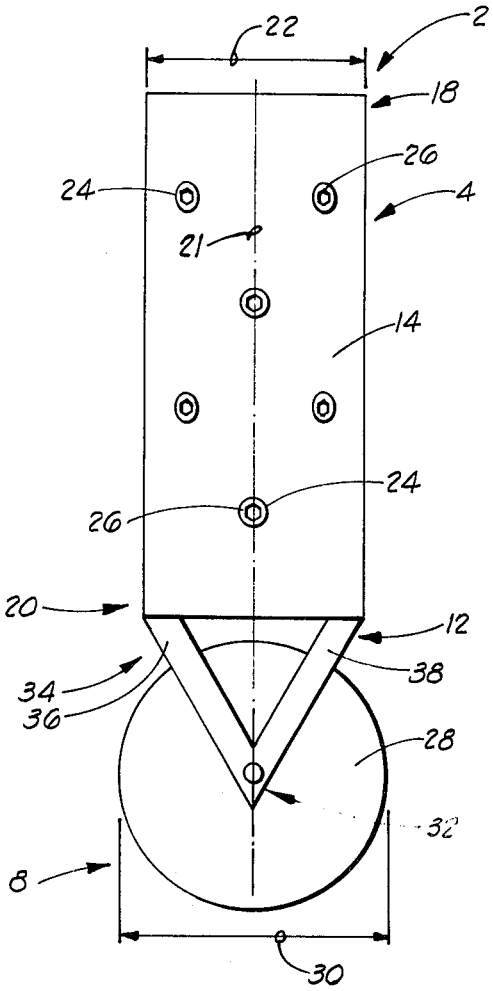
FIG. 1 is a side elevational view of the present invention.

Referring to the drawings an apparatus 2 constructed in accordance with the preferred embodiment of the present invention will be described. The apparatus 2 includes an adapter shoe means 4 for coupling the apparatus 2 with a tool 6, such as a well logging tool for example (see FIGS. 4 and 5). The apparatus 2 also includes roller means 8 for engaging a wall 10 which is shown in FIG. 5 to define a well bore. The apparatus 2 further includes attachment means 12 for attaching the roller means 8 to an end of the adapter shoe means 4.

The adapter shoe means 4 of the preferred embodiment shown in the drawings includes a tubular sleeve specifically shown as a cylindrical wall 14 which defines a longitudinal hollow interior region 16 for receiving an end of the tool 6. The cylindrical wall 14 extends longitudinally between a first end 18 and a second end 20. The first end 18 and the second end 20 are longitudinally spaced from each other. This longitudinal separation is in a direction parallel to the longitudinal axis of the cylindrical wall 14. The longitudinal axis is represented in FIG. 1 by a reference line 21.

The cylindrical wall 14 has an outer periphery defining a first diameter indicated in FIG. 1 by the dimensional line marked with the reference numeral 22. This first diameter 22 is the maximum outer dimension of the tubular sleeve defined by the cylindrical wall 14. This first maximum outer dimension is measured perpendicularly to the direction of the longitudinal spacing between the first end 18 and the second end 20.

The cylindrical wall 14 has a plurality of threaded holes 24 defined therethrough. The holes 24 are spaced circumferentially around and longitudinally along the tubular sleeve defined by the cylindrical wall 14.

Figure 4:
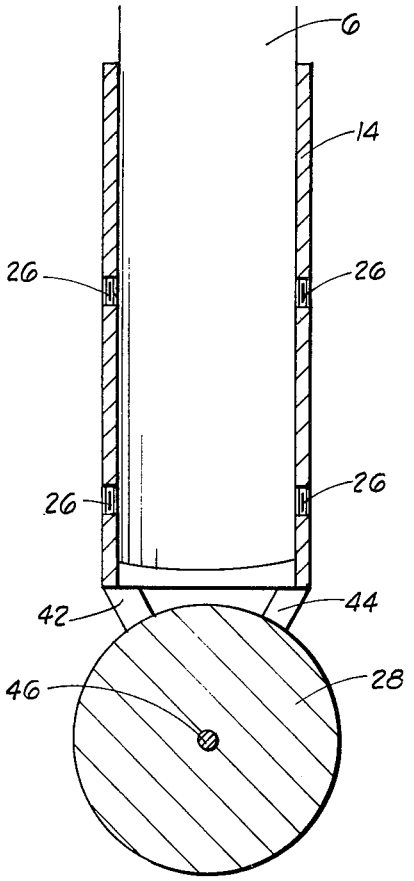
FIG. 4 is a cross-sectional view of the present invention connected to a well logging tool.
Figure 2:
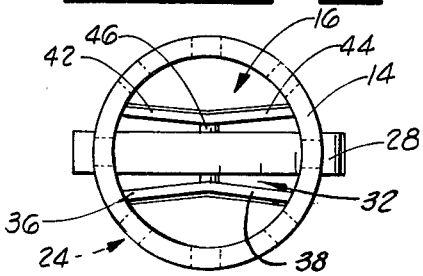
FIG. 2 is a top plan view of the present invention.
Figure 3:
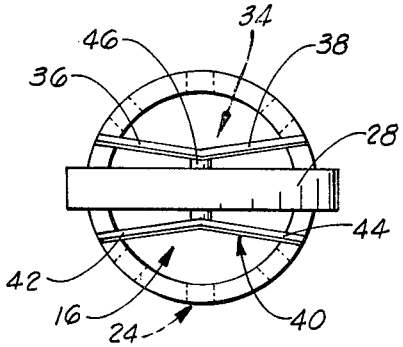
FIG. 3 is a bottom view of the present invention.
Figure 5:
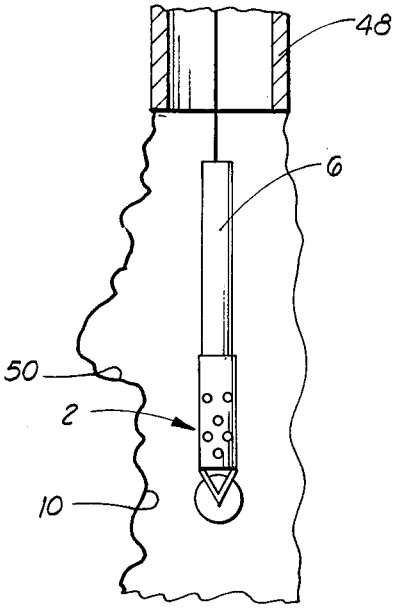
FIG. 5 is a schematic view of a tool, having the present invention attached thereto, disposed in a well.

The adapter shoe means 4 also includes securing means for releasably securing the wall 14 to the tool 6 when the tool 6 is received in the interior region 16 as illustrated in FIG. 4. The securing means includes a plurality of fastening means which in the preferred embodiment are Allen screws 26. Each of the plurality of Allen screws 26 is disposed in a respective one of the threaded holes 24 as illustrated in FIGS. 1 and 4. Other suitable securing means can be used, such as a threaded connector for coupling with a mated connector contained on the tool or other object with which the apparatus 2 can be used.

The roller means 8 of the preferred embodiment includes a wheel 28 having an outer periphery defining a second diameter identified in FIG. 1 by the dimensional line marked with the reference numeral 30. The diameter 30 is the maximum outer dimension of the roller means 8 and is measured in the preferred embodiment parallel to the first maximum outer dimension which was hereinabove stated to be measured perpendicularly to the direction of the longitudinal spacing between the first and second ends of the adapter shoe means 4. The second diameter 30 is shown in the preferred embodiment to be greater or larger than the first diameter 22. That the diameter 30 is greater than the diameter 22 is important because it enables the present invention to properly assist the movement of the tool 6 into the hole. Although the diameter 30 is greater than the diameter 22, it is not substantially larger in the preferred embodiment so that the present invention is capable of use in well bores having inner diameters not substantially larger than the outer diameter of the tool 6 with which the apparatus 2 is to be used. In the preferred embodiment the diameter 30 is approximately one-half inch larger than the diameter 22.

Although the preferred embodiment discloses the roller means 8 includes a wheel 28, other suitable types of rolling mechanisms, such as a universal ball-type roller, can be used. The preferred embodiment wheel 28 can be constructed to have a serrated outer periphery.

The roller means 8 is connected to the adapter shoe means 4 by the attachment means 12. In the preferred embodiment the attachment means 12 particularly retains the roller means 8 in longitudinally spaced relationship with the adapter shoe means 4. As shown in FIG. 1, the attachment means 12 attaches the wheel 28 to the wall 14 on an axis of rotation which is perpendicular to and intersects an extension of the longitudinal axis 21 of the cylindrical wall 14. This disposition of the roller means 8 is important because it places the roller means 8 beneath the tool 6 as the tool is lowered into the well, thereby causing the roller means 8 rather than the end of the tool 6 to engage the wall 10 of the well. This enables the tool 6 to roll off ledges in the wall 10.

The preferred embodiment attachment means 12 includes brace means having a first end connected to an end of the wall 14 and having a second end converging from the first end to a locus of connection 32 through which an extension of the longitudinal axis of the wall 14 passes. The brace means particularly includes a first brace member 34 having two legs 36, 38. Each of the legs 36, 38 has an end suitably connected to a respective location on the circumference of the second end 20 of the adapter shoe means 4. This connection can be by welding or by being integrally formed with the wall 14 or by other suitable means known to the art. The legs 36, 38 have second ends which are joined at the locus of connection 32. The brace means includes a second brace member 40 having legs 42, 44 connected to the wall 14 in a manner similar to legs 36, 38 as is apparent from the drawings. The brace members 34, 40 extend below the second end 20 of the adapter shoe means 4 when the adapter shoe means 4 is vertically oriented with the first end 18 above the second end 20 as illustrated in FIG. 1. A portion of the locus of connection 32 is coincident with an extension of the longitudinal axis 21 of the cylindrical wall 14.

The attachment means 12 further includes retainer means for rotatably retaining the roller means 8 to the brace means at the locus of connection 32. In the preferred embodiment the retainer means includes an axle 46 connected to the brace members 34, 40 so that the wheel 28 rotates about an axis which extends transverse to the direction of the longitudinal spacing between the first and second ends 18, 20 of the adapter shoe means 4. The axle 46 can be journaled in the brace members 34, 40 as known to the art or it can be secured, such as by welding, thereto if the wheel 28 is journaled on the axle 46.

The apparatus 2 is constructed of any suitable material as known to the art. For example, the apparatus can be fabricated of a malleable material so that it can be readily drilled should it be lost in the well bore.

In operation the apparatus 2 is secured to the tool 6 by inserting the lower end of the tool 6 into the interior region 16 of the adapter shoe means 4 as illustrated in FIGS. 4 and 5 (wherein the tool 6 is shown to have a maximum width or exterior lateral dimension which is less than either of the dimensions 22 or 30) and then tightening the Allen screws 26 against the outer surface of the tool 6. With the apparatus 2 secured to the tool 6, the tool 6 is lowered by suitable means known to the art into the well bore shown in FIG. 5 to be defined by the wall 10 which is partially cased by a casing 48.

As illustrated in FIG. 5, the uncased portion of the wall 10 has several indentations on which the tool 6 could become lodged and from which it would have to be "yo-yoed" to be removed therefrom if the apparatus 2 were not attached to the tool 6. One of these indentations is identified in FIG. 5 as having a ledge 50.

With reference to the ledge 50, it will be noted that if the tool 6 were to laterally move in the well bore, the wheel 28 of the apparatus 2 would engage the wall 10, including the ledge 50 so that the tool 6 is prevented from becoming stuck. That is, because the wheel 28 rotates, it will continually roll off the indentations, such as the ledge 50, as the tool 6 is lowered deeper into the well.

It is to be noted that the apparatus 2 also can run along the interior surface of the well bore casing. The apparatus can also be used with wire line tools or casing or other objects which are lowered into a well.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for assisting the lowering of an object having a maximum exterior lateral dimension into a well, the well having a wall defining an uncased well bore and the wall having a ledge defined therein, whereby the object is prevented from becoming stuck on the ledge, said apparatus comprising:

adapter shoe means for coupling said apparatus with the object, said adapter shoe means having a first end and a second end longitudinally spaced from said first end and said adapter shoe means having a maximum outer dimension measured perpendicularly to the direction of longitudinal spacing between said first and second ends;

roller means for engaging the wall of the well bore, said roller means having a maximum outer dimension measured parallel to said maximum outer dimension of said adapter shoe means, said maximum outer dimension of said roller means being greater than said maximum outer dimension of said adapter shoe means and being greater than said maximum exterior lateral dimension of said object; and roller attachment means for attaching said roller means to said second end of said adapter shoe means in longitudinally spaced relationship therewith.

2. The apparatus of claim 1, wherein said adapter shoe means includes a tubular sleeve extending longitudinally between said first and second ends.

3. The apparatus of claim 2, wherein:

said sleeve has a plurality of holes defined therethrough, said holes being spaced circumferentially around and longitudinally along said sleeve; and said adapter shoe means further includes a plurality of fastening means for fastening said adapter shoe means to the object, each of said fastening means being disposed in a respective one of said holes.

4. The apparatus of claim 3, wherein said roller attachment means includes two brace members attached to said second end of said adapter shoe means, said brace members being disposed below said second end of said adapter shoe means when said adapter shoe means is vertically oriented with said first end above said second end, and said brace members being further disposed so that they converge toward each other to a locus of connection having a portion thereof coincident with an extension of the longitudinal axis of said tubular sleeve.

5. The apparatus of claim 4, wherein said roller attachment means further includes axle means for rotatably connecting said roller means to said brace members at said locus of connection.

6. The apparatus of claim 5, wherein said axle means is connected to said brace members so that said roller means rotates about an axis transverse to the longitudinal axis of said tubular sleeve.

7. The apparatus of claim 1, wherein said roller attachment means includes two brace members attached to said second end of said adapter shoe means, said brace members being disposed below said second end of said adapter shoe means when said adapter shoe means is vertically oriented with said first end above said second end, and said brace members being further disposed so that they converge toward each other to a locus of connection.

8. The apparatus of claim 7, wherein said roller attachment means further includes axle means for rotatably connecting said roller means to said brace members at said locus of connection.

9. The apparatus of claim 8, wherein said axle means is connected to said brace members so that said roller means rotates about an axis transverse to the direction of longitudinal spacing between said first and second ends of said adapter shoe means.

10. An apparatus for preventing a tool from becoming lodged on a ledge in an oil or gas well bore, comprising:

a cylindrical wall defining a longitudinal hollow interior region for receiving an end of the tool;

securing means for releasably securing said wall to the tool when the tool is received in said interior region;

a wheel having a diameter greater than the maximum width of the tool so that said wheel will engage said well bore before the end of the tool received in said cylindrical wall when the tool is received therein and the tool and said apparatus are lowered into the well bore; and attachment means for attaching said wheel to said wall on an axis of rotation which is perpendicular to and intersects an extension of the longitudinal axis of said cylindrical wall so that said wheel is below the tool when said cylindrical wall receives the tool.

11. The apparatus of claim 10, wherein:

said wall has a plurality of threaded holes defined therein; and said securing means includes a plurality of Allen screws, each of said Allen screws being disposed in a respective one of said threaded holes.

12. The apparatus of claim 11, wherein said attachment means includes:

brace means having a first end connected to an end of said wall and having a second end converging from said first end of said brace means to a locus of connection, said locus of connection having the extension of the longitudinal axis of said wall passing therethrough; and retainer means for rotatably retaining said wheel to said brace means at said locus of connection.

13. The apparatus of claim 10, wherein said attachment means includes:

brace means having a first end connected to an end of said wall and having a second end converging from said first end of said brace means to a locus of connection, said locus of connection having the extension of the longitudinal axis of said wall passing therethrough; and retainer means for rotatably retaining said wheel to said brace means at said locus of connection.

* * * * *